United States Patent [19]

Paul

[11] 4,161,251

[45] Jul. 17, 1979

[54] INSPECTION FIXTURE

[76] Inventor: William A. Paul, 1808 Parkside Blvd., Toledo, Ohio 43607

[21] Appl. No.: 751,449

[22] Filed: Dec. 16, 1976

[51] Int. Cl.[2] ..... B07C 5/08

[52] U.S. Cl. ..... 209/604; 209/626; 209/698

[58] Field of Search ..... 209/82, 81 R, 74 R, 209/73, 72, 600, 601, 604, 626, 625, 627, 698; 33/143 L, 149 J, 149 R, 168 B; 198/102, 6 R, 7, 8

[56] References Cited

U.S. PATENT DOCUMENTS

| | | | |
|---|---|---|---|
| 2,409,265 | 10/1946 | Fenton | 209/82 |
| 2,627,345 | 2/1953 | Yates | 209/82 X |
| 2,740,521 | 4/1946 | Calvin | 209/82 |
| 2,792,920 | 5/1957 | Sutphen et al. | 194/6 |
| 2,907,458 | 10/1959 | Scharein | 209/82 |
| 3,191,739 | 6/1965 | White, Jr. | 194/102 X |
| 3,455,443 | 7/1969 | Wilder | 209/74 R |
| 3,480,140 | 11/1969 | Unkefer | 209/81 R X |
| 3,537,579 | 11/1970 | Roberson | 209/82 X |
| 3,710,935 | 1/1973 | Heiser | 209/82 X |
| 3,737,033 | 6/1973 | Toth et al. | 209/82 X |

*Primary Examiner*—Joseph J. Rolla
*Assistant Examiner*—Edward M. Wacyra
*Attorney, Agent, or Firm*—Allen D. Gutchess, Jr.

[57] ABSTRACT

An electronic inspection fixture is provided which checks a dimension of objects and rejects oversized ones. The inspection fixture includes spaced conducting members set apart at a fixed distance and preferably placed one above the other at angles to the horizontal which enables objects to slide between the members by gravity. An oversized object completes a circuit between the members and causes a fluid-operated cylinder to move the upper member away from the lower one to release the object. The circuit also operates a second fluid-operated cylinder which moves a diverter member into the path of the objects to divert oversized objects from the normal path thereof. Objects which are not oversized pass between the members and past the diverter member.

3 Claims, 4 Drawing Figures

INSPECTION FIXTURE

This invention relates to an electronic inspection fixture which automatically determines objects which are oversize and rejects them.

The inspection fixture according to the invention requires no labor for operation and is also relatively low in cost yet is reliable and substantially maintenance free. The inspection fixture in its specific form includes a lower conducting member placed at an angle such that objects can slide down it and an upper conducting member spaced therefrom in parallel relationship. The upper member is adjustably movable toward and away from the lower one and also is provided with a fluid-operated cylinder which is actuated to raise at least a portion of the upper member to space it farther from the lower member when an object that is oversized contacts both of the members. A diverter member is positioned to intersect a discharged object if it is oversized and divert it from a normal path. This member is moved to the intersecting position from a spaced position by a fluid-operated cylinder which is also actuated when an oversized object contacts both of the upper and lower members.

It is, therefore, a principal object of the invention to provide an automatic, electronic inspection fixture having the advantages discussed above.

Many other objects and advantages of the invention will be apparent from the following detailed description of a preferred embodiment thereof, reference being made to the accompanying drawings, in which.

Figure 1:
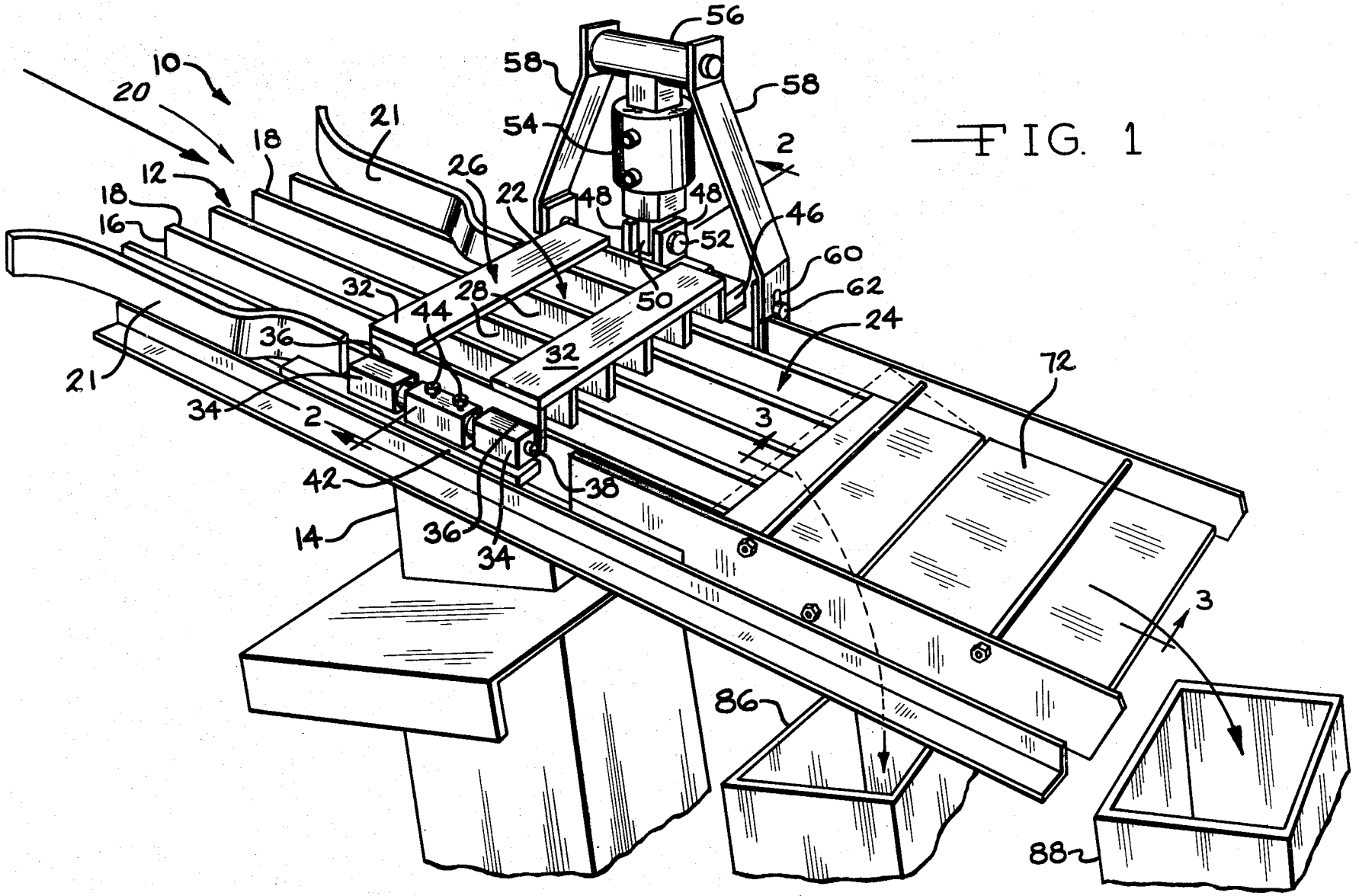
FIG. 1 is a view in perspective of an overall electronic inspection fixture embodying the invention.

Referring to the drawings, and particularly to FIG. 1, an electronic inspection fixture according to the invention is indicated at 10 and includes an object support or member 12. The support 12 is located at a suitable angle to the horizontal by a lower frame 14, the angle being such that an object will slide along the support when placed at the upper end thereof. The object support or member 12 actually consists of a plurality of bars 16 having upper surfaces 18 lying in a common plane. This design enables dirt and other contaminants to fall through without lying on the surface and impeding the inspection of objects. The object support 12 includes an entrance portion 20 having side guide rails 21, an intermediate portion 22, and a discharge portion 24.

An upper conducting member 26 is located above the intermediate portion 22 of the support 12. The upper member 26 comprises a plurality of bars 28 having lower surfaces 30 (FIG. 2) which are spaced above the surfaces 18 of the support 12 in parallel relationship and at a predetermined distance. The bars 28 are held in fixed, spaced relationship parallel to the bars 16 by upper struts 32. The left edge portion of the member 26 is movably held in spaced relationship from the support 12 by a hinge arrangement which includes hinge ears or blocks 34 (FIG. 1) affixed to the edge bar 28 of the member 26 with insulating plates 36 therebetween. Hinge pins 38 are rotatably held in the blocks 34 and are, in turn, supported by and project outwardly in coaxial relationship from a center supporting block 40. This block is adjustably mounted on a plate member 42 of the support 12 by two adjusting screws 44 which enable the block 40 to be raised and lowered and, accordingly, raise and lower the surfaces 30 of the member 26.

The opposite or right edge portion of the upper member 26 has an extension bar 46 which has a pair of ears 48 extending upwardly therefrom and which receive a lower end of a piston rod 50. These are connected by a suitable pin 52 which extends through openings in the rod 50 and in the ears 48. The piston rod 50 extends into a hydraulic or fluid-operated cylinder 54 which is pivotally supported at its opposite end by a supporting rod 56 pivotally held by legs 58. The legs have slots 60 and fasteners 62 to raise or lower the cylinder 54 and thereby adjust the right edge portion of the member 26 relative to the lower member 12. The legs 58 are supported on a plate 64 which is connected to a lower base 66 of the support 12. An insulating plate 68 is located between the ears 48 and the bar 46.

Figure 2:
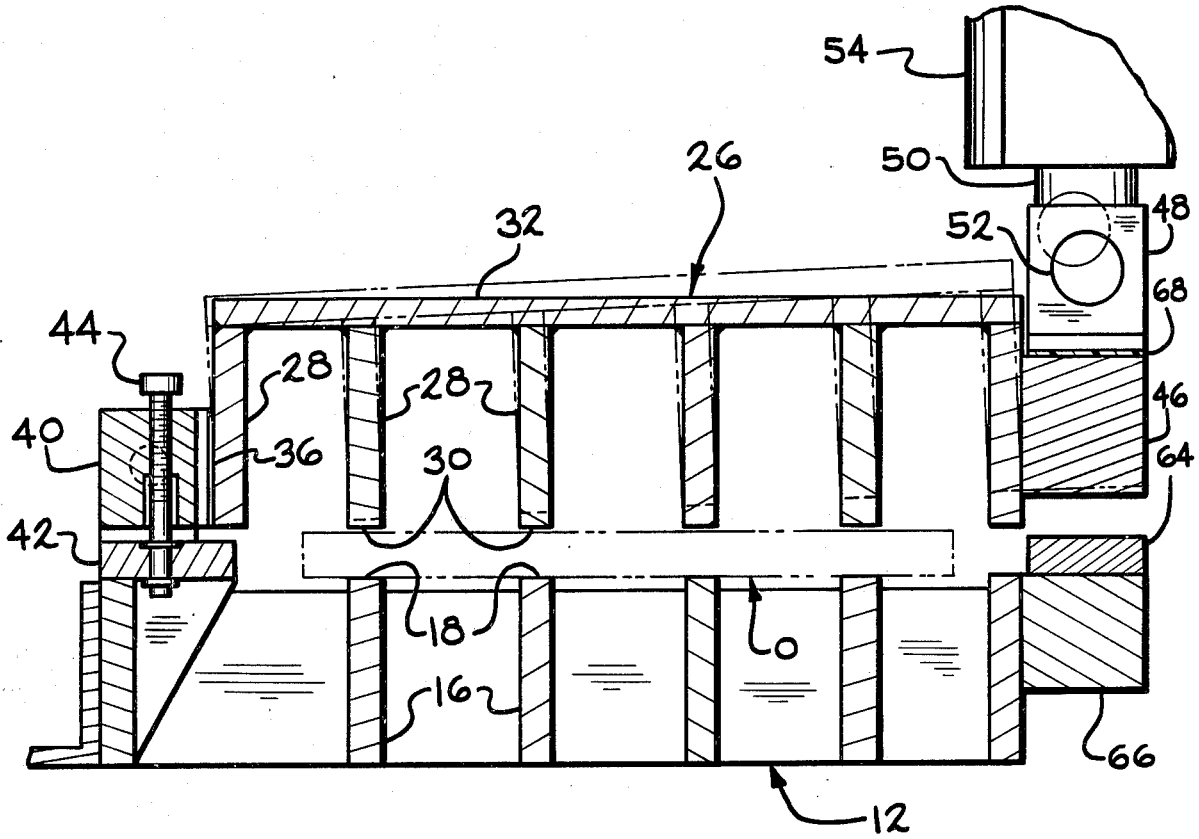
FIG. 2 is an enlarged view in transverse cross section taken along the line 2—2 of FIG. 1.

When an object designated O in FIG. 2 is placed upon the entrance portion 20 of the support 12 of FIG. 1, it slides down the bars 16 to the intermediate portion 22 of the support. If the thickness, in this instance, of the object O is oversized, the object will contact the surfaces 18 of the bars 16 and the surfaces 30 of the bars 28 to complete an electrical circuit therebetween. This causes the cylinder 56 to be actuated and to retract the piston rod 50, thereby raising the upper member 26 from the support 12 and releasing the object. The object O can then proceed to slide down the intermediate portion 22 to the discharge portion 24.

Figure 3:
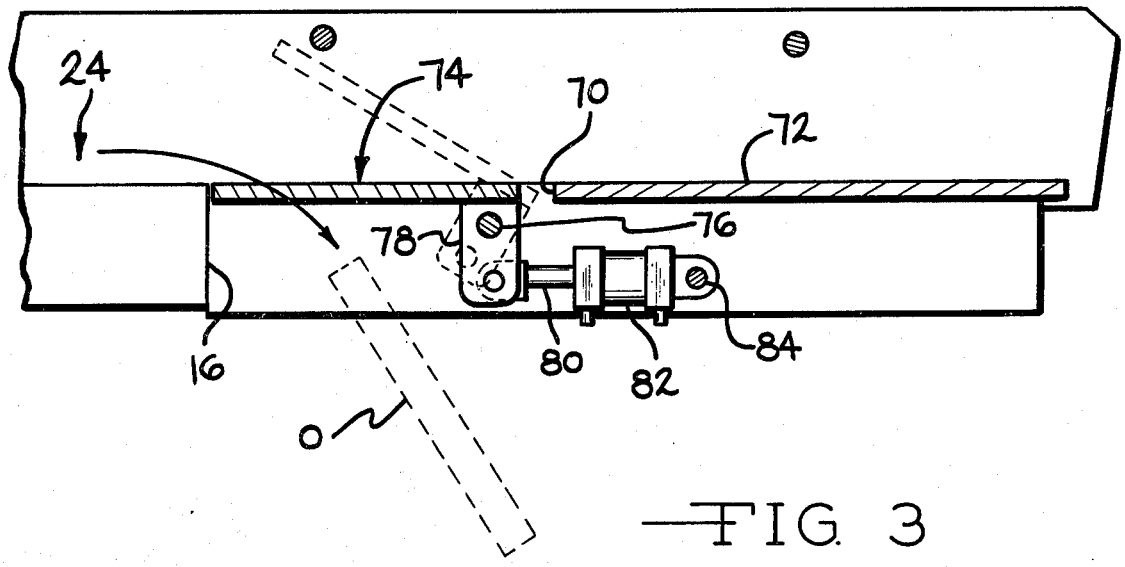
FIG. 3 is an enlarged view in transverse cross section taken along the line 3—3 of FIG. 1.

A discharge opening 70 is located adjacent the discharge portion 24 of the support 12 and, specifically, is formed between the end of the discharge portion 24 and a discharge platform 72 located downstream thereof. A diverter member or plate 74 is located at the discharge opening 70 and is pivotally supported by a pin 76 extending across the fixture and received in ears 78 which are affixed to the plate 74 at one end and are pivotally connected to a piston rod 80 of a cylinder 82 at the lower end, below the pivot pin 76. The cylinder 82, in turn, is pivotally supported on a rod 84 extending across the fixture. The cylinder 82 moves the plate 74 from a position in which it covers the opening 70 and is out of the path of the objects moving down the fixture to a second position in which it is spaced from the opening 70 and intersects the path of the objects, as shown in dotted lines in FIG. 3. It will be readily understood that the diverter member could be placed above the discharge portion 24 of the support 12 or above the discharge platform 72 and moved in a horizontal path to move the objects off the side of the fixture, if desired.

The diverter plate is normally in the first position covering the opening 70. When the object O contacts the surfaces 18 and 30 to complete the circuit, the cylinder 82 is actuated to extend the piston rod 80. This moves the diverter plate 74 to the upper position whereby the oversized object moving down the support 12 will fall through the opening 70, with the plate intersecting the object to assure its discharge through the opening. These oversized objects fall into a reject receptacle or bin 86 of FIG. 1 whereas objects which are not oversized proceed down to discharge section 24 past the diverter plate 74 and past the discharge platform 72 into a receptacle or bin 88.

Figure 4:
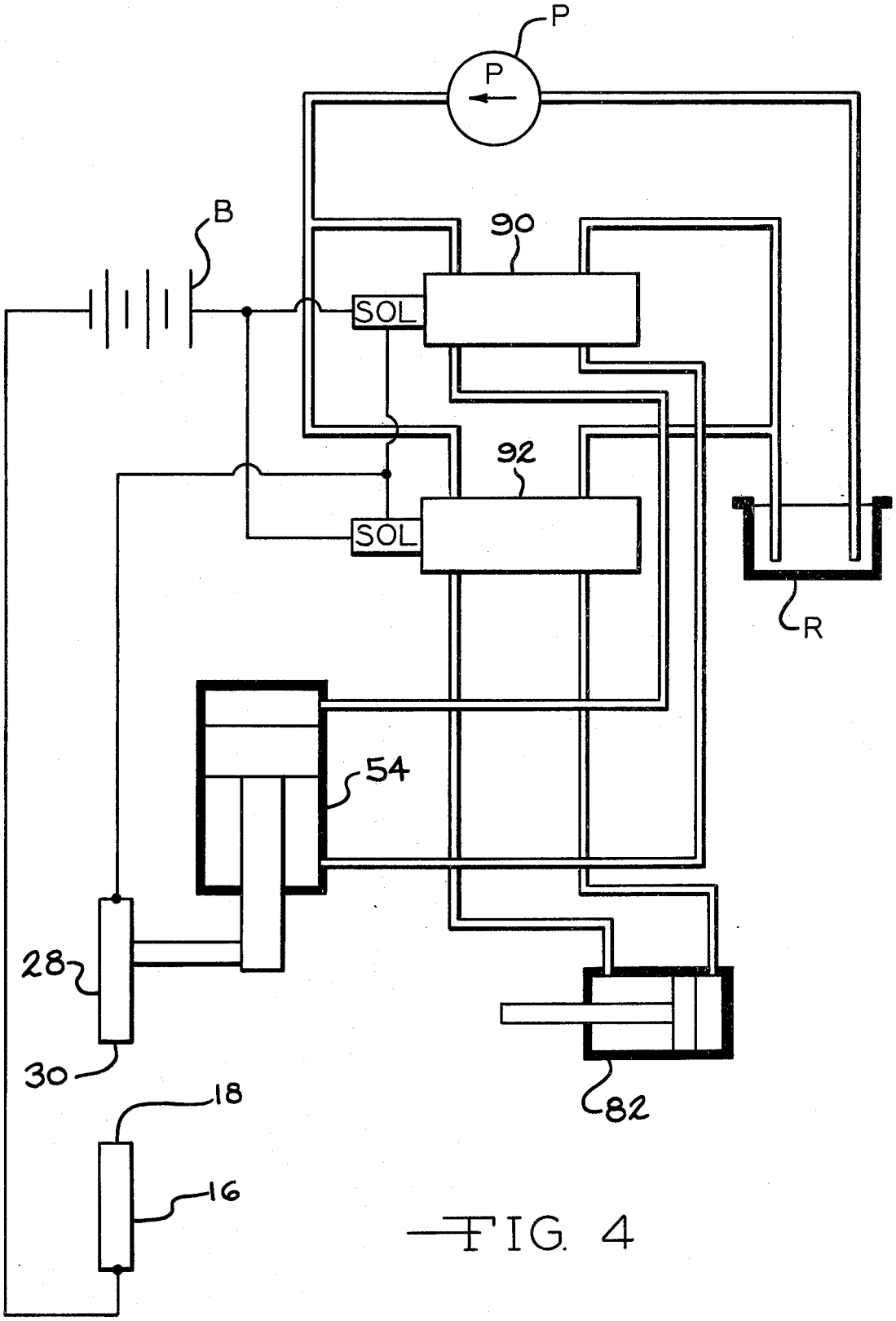
FIG. 4 is a diagrammatic view of an electrical circuit and hydraulic system for operating the inspection fixture.

While the operation of the electronic inspection fixture will be apparent from the above description, a brief reference thereto will be made in connection with the diagrammatic circuit and system of FIG. 4. A suitable source of power indicated as a battery B is connected to two solenoid-operated, four-way valves 90 and 92. The valves 90 and 92 are connected to a suitable hydraulic system comprising a pump P and a reservoir R and also to the cylinders 54 and 82, respectively. The solenoids of the valves 90 and 92 are also electrically connected to one of the members 12 and 26 while the battery B is electrically connected to the other of the members 12 and 26. Specifically, the solenoids are shown as connected to the bars 28 of the upper member 26 and the battery B is connected to the bars 16 of the member 12.

When the object O contacts the surfaces 18 and 30 to complete a circuit between the battery B and the valve solenoids, the solenoid of the valve 90 causes it to supply fluid under pressure to the rod end of the cylinder 54 and thereby cause the member 26 to move away from the member 12 and release the object which had made contact between the surfaces 18 and 30. The valve 90 can be provided with a delay in the hydraulic system to prevent immediate return of the piston rod to its extended position to assure that the object will continue to slide down the support 12 and past the intermediate portion 22 before the member 26 is again moved to its lower, spaced position with respect to the member 12.

When the solenoid of the valve 92 is actuated, the valve supplies fluid under pressure to the blind end of the cylinder 82 to extend the piston rod 80 and to move the diverter member 74 to its upper position, intersecting the path of the oversized object and providing access to the discharge opening 70. Again, the valve 92 can have a delay built in the hydraulic system which will cause the rod 80 to remain extended for a sufficient period to assure that the oversized object O has slid past the discharge portion 24 of the member 12 and through the opening 70 toward the bin 86. In place of time delays built into the hydraulic system, time delay relays or other suitable components can be provided in the electric circuit.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. An inspection fixture comprising a lower object support having an entrance portion, an intermediate portion, and a discharge portion, said intermediate portion of said lower object support being of conductive material, an upper conducting member, means for movably supporting said upper conducting member in a first position above said intermediate portion of said lower object support, fluid-operated means for moving said conducting member from the first position to a second position further spaced from said intermediate portion, means for supporting said lower object support at an angle to the horizontal whereby an object placed on said entrance portion will move by gravity past said intermediate and said discharge portions, a source of electrical power connected between the said conducting member and said intermediate portion of said lower object support, valve means in series with said source of power for actuating said fluid-operated means to move said conducting member from the first position to the second position when an object contacts both said conducting member and said intermediate portion of said lower object support to complete a circuit between said valve means and said power source, means forming an opening associated with said discharge portion, a diverter plate, and means operated by said valve means for moving said diverter plate from a first position covering said opening whereby objects passing over said discharge portion can pass over said opening, and a second position spaced from said opening whereby objects passing over said discharge portion will drop through said opening.

2. An inspection fixture comprising a lower conducting member on which objects to be inspected are supported, an upper conducting member, a fluid-operated cylinder for movably supporting a first portion of said upper member between one position at a fixed distance above said lower member and another position spaced further above said lower member, means for supporting a second portion of said upper member at a fixed distance above said lower member, a source of electrical power connected between said upper and lower members, electrically-operated valve means in series with said source of power for supplying fluid under pressure to said fluid-operated cylinder to move said upper member away from said lower member when an object contacts both of said upper and lower members to complete a circuit between said valve means and said electrical power source, means for supporting objects after passing between said upper and lower members and having an opening therein, a diverter plate, a second fluid-operated cylinder to move said diverter plate between a first position over said opening whereby objects may pass thereover, and a second position spaced from said opening whereby objects can pass therethrough, said electrically-operated valve means supplying fluid under pressure to said second fluid-operated cylinder to move said diverter plate from the first position to the second position when an object contacts both of said upper and lower members.

3. An inspection fixture comprising a lower object support having an entrance portion, an intermediate portion, and a discharge portion, said intermediate portion of said lower object support being of conductive material, an upper conducting member, means for movably supporting said conducting member in a first position above said intermediate portion of said lower object support, fluid-operated means for moving said conducting member from the first position to a second position further spaced from said intermediate portion, said movably supporting means comprising means for pivotally supporting one end of said conducting member above said intermediate portion of said lower object support, and said fluid-operated means being connected to a second end of said conducting member for moving said conducting member from the first position to the second position, means for adjustably moving said pivot means toward and away from said intermediate portion, means for supporting said lower object at an angle to the horizontal whereby an object placed on said entrance portion will move by gravity past said intermediate and said discharge portions, a source of electrical power connected between said conducting member and said intermediate portion of said lower object support, and valve means in series with said source of power for actuating said fluid-operated means to move said conducting member from the first position to the second position when an object contacts both said conducting member and said intermediate portion of said lower object support to complete a circuit between said valve means and said power source.

* * * * *